United States Patent [19]

Shupe

[11] 4,166,291

[45] Aug. 28, 1979

[54] CHORD LINER USING ANGLE MEASUREMENT

[75] Inventor: Charles A. Shupe, Beaconsfield, Canada

[73] Assignee: Canron, Inc., New York, N.Y.

[21] Appl. No.: 862,852

[22] Filed: Dec. 21, 1977

[51] Int. Cl.[2] ..... E01B 33/02

[52] U.S. Cl. ..... 364/560; 33/287; 238/174; 364/571

[58] Field of Search ..... 364/571, 560; 33/287, 33/338; 324/217; 104/4, 118, 124; 238/166, 174

[56] References Cited

U.S. PATENT DOCUMENTS

| | | | |
|---|---|---|---|
| 2,531,461 | 11/1950 | Petry | 33/287 |
| 3,144,834 | 8/1964 | Stewart | 33/287 |
| 3,165,073 | 1/1965 | Blix et al. | 33/287 |
| 3,514,862 | 6/1970 | Helgemeir | 33/338 |
| 3,523,372 | 8/1970 | Stewart | 33/287 |
| 3,664,265 | 5/1972 | Sauterel et al. | 33/287 |
| 3,795,056 | 3/1974 | Plasser et al. | 33/287 |
| 3,821,933 | 7/1974 | Plasser et al. | 33/287 |
| 3,875,865 | 4/1975 | Plasser et al. | 33/287 |
| 4,027,397 | 6/1977 | Theurer et al. | 33/287 |

FOREIGN PATENT DOCUMENTS

| | | | |
|---|---|---|---|
| 1801758 | 8/1975 | U.S.S.R. | 364/560 |

*Primary Examiner*—Errol A. Krass
*Attorney, Agent, or Firm*—Wenderoth, Lind & Ponack

[57] ABSTRACT

A track aligning device for monitoring the curvature of a track and adjusting the track successively to correct the curvature incorporates three rods mounted on a car or cars running on the track and pivotably connected together, the rods defining three chords each extending between a pair of spaced points located on the track center line. The angle between the first rods is measured by a transducer which derives a voltage dependent on the magnitude and direction of the angle. This voltage is sampled at equal intervals, say two meters, as the aligning device passes along the track. The voltages are summed and averaged electrically and a voltage equivalent to the mean angle between the first two rods is obtained. The angle between the second two rods is measured by a second transducer which derives a voltage equivalent to the actual angle at a particular position of the track. This voltage is compared electrically with the mean voltage and an error voltage is derived and used to operate a servo-assisted aligning mechanism to adjust the track to the left or right as necessary. The device can also adjust the superelevation of the track to meet the necessary value as computed on the basis of curvature and speed.

27 Claims, 3 Drawing Figures

CHORD LINER USING ANGLE MEASUREMENT

BACKGROUND OF THE INVENTION

This invention relates to track alignment devices and, more particularly, to track alignment devices utilizing a "chord system" to obtain track alignment error and correct track alignment.

It has previously been proposed in Russian Pat. No. 471,413 which was granted on May 25, 1975 to Turovskiy et al, to use a wire stretched between forward and rearward stations of a track alignment device, the wire serving as a chord of a curved section of the track over which the alignment device is passing to establish a datum or reference line. A first measuring device located relatively near the forward station cooperates with the wire to measure the distance of the track at successive points from the reference line. A predetermined number of measurements are obtained and averaged. A second measuring device located relatively near the rearward station cooperates with the wire to measure successively the distance from the reference line of the track at a point immediately forwardly of the already corrected track portion. The actual value obtained is compared with the mean value obtained from the first measuring device and an error signal generated if there is a difference. The error signal causes an alignment mechanism to shift the track in a direction left or right and by an amount to remove or reduce the error.

This prior system suffers from the disadvantage that the length of the chord is limited plysically by the practical problems associated with supporting the wire on rail cars. This places a practical limitation on the precision of the measurements because the longer the chord the more precise the measurements.

Another disadvantage of the prior system is that because the first measuring device is located near the forward end of the wire then, if the forward end of the wire is on a badly misaligned point on the track, a large deviation from a "true" displacement from the reference will be present in the reading obtained.

Copending U.S. application Ser. No. 844,819, filed Oct. 25, 1977, and assigned to a common assignee describes and claims a system in which two chords are used, the first measuring device being located on the first chord and the second measuring device being located on the second chord.

SUMMARY OF THE INVENTION

According to one aspect of the present invention there is provided a method of reducing railroad track alignment errors comprising the steps of passing a measuring system over a section of the track and measuring the angle defined by the track relative to a reference line at a first series of locations throughout the section, automatically summing and averaging the measured angles to obtain an average value, passing track correcting means equipped with a track angle sensing means over the same section of track, obtaining a value for the angle defined by the track relative to the reference line at at least one location on the section, comparing the actual angle value sensed with the average angle value computed to obtain an angle error value and applying the angle error value to control the operation of track position correcting means to reduce an existing track alignment error at the one location.

According to another aspect of the invention, there is provided apparatus for reducing railroad track alignment errors comprising a first measuring system having a measuring means for measuring the variable angle defined by the track relative to a reference line, means to move the first measuring system over a section of track whereby the measuring means measures the variable angle at a first series of locations, means to store and average the values obtained at the first series of locations, a track correcting means attached to and trailing the first measuring system, a second measuring system associated with the track correcting means for measuring the variable angle defined by the track relative to the reference line at at least one location on the section, means to compare the actual angle value obtained at the at least one location with the averaging angle value computed to obtain an angle error value, and means for applying the angle error value to control the operation of the track position correcting means to reduce an existing track alignment error at the one location.

According to another aspect of the present invention, there is provided apparatus for reducing railroad track alignment error comprising a first measuring system having a first forward chord both ends of which are located adjacent pairs of track engaging wheels and each end being located intermediate a respective pair of wheels and a first rearward chord both ends of which are located adjacent pairs of track engaging wheels and each end being located intermediate a respective pair of wheels, the rearward end of the first forward chord being fixed closely adjacent the forward end of the first rearward chord, the chords being relatively pivotable to define a variable angle therebetween measured at the adjacent ends of the two chords, means located at the adjacent ends of the chords to measure the variable angle, means to move the first measuring system over a section of track whereby the variable angle measuring means measures the variable angle at a series of locations, means to store and average the values obtained at the series of locations, a track correcting means attached to and trailing the first measuring system, a second measuring system associated with the track correcting means and having a second forward chord both ends of which are located adjacent pairs of track engaging wheels and each end being located intermediate a respective pair of wheels and a second rearward chord both ends of which are located adjacent pairs of track engaging wheels and each end being located intermediate a respective pair of wheels, the rearward end of the second forward chord being fixed closely adjacent the forward end of the second rearward chords, the chords being relatively pivotable to define a variable angle therebetween measured at the adjacent ends of the two chords, means located at the adjacent ends of the second two chords to measure the angle at a particular track location, means to compare the average angle value with the angle value obtained by the second measuring system at the particular track location and provide an angle error value, and means for applying said angle error value to control the operation of the track correction means to reduce an existing track alignment error.

According to a further aspect of the invention, there is provided a method of correcting the superelevation of one rail relative to the other in accordance with a predetermined formula relating superelevation to curvature of a section track and the speed for which the track section is designed, comprising the steps of passing a measuring system over the section and obtaining measurements indicative of the track position at a first series of locations throughout the section automatically summing and averaging the measurements to obtain an average value automatically computing a desired superelevation value using the average value, passing track correcting means equipped with track measurement means over the same section of track and obtained a measurement at at least one location which measurement is indicative of the superelevation of the rails at that location, comparing the computed superelevation value with the value obtained at the one location to obtain an error signal and applying the error signal to control the operation of track lifting means to raise one rail relative to the other to achieve the computed superelevation.

According to yet another aspect of the invention, there is provided apparatus for correcting the superelevation of one rail relative to another on a section of track comprising a first measuring system having measuring means adapted to obtain a measurement with respect to a reference line which measurement is indicative of the track position, means to move the first measuring system over a section of track whereby the measuring means obtains measurements at a first series of locations, means to store and average the values obtained at the first series of locations, means to compute automatically from the average value and a desired operating speed of the section a value for the superelevation of the section, a track connecting means attached to and trailing the first measuring system, a second measuring system associated with the track correcting means for measuring the elevation of one rail with respect to the other at at least one location on the section to obtain an actual superelevation value, means to compare the actual superelevation value with the computed superelevation value to obtain an error value, and means for applying the error value to control the operation of the track correcting means to raise one line relative to the other to achieve the computed superelevation value.

DESCRIPTION OF THE PREFERRED EMBODIMENT

Figure 1:
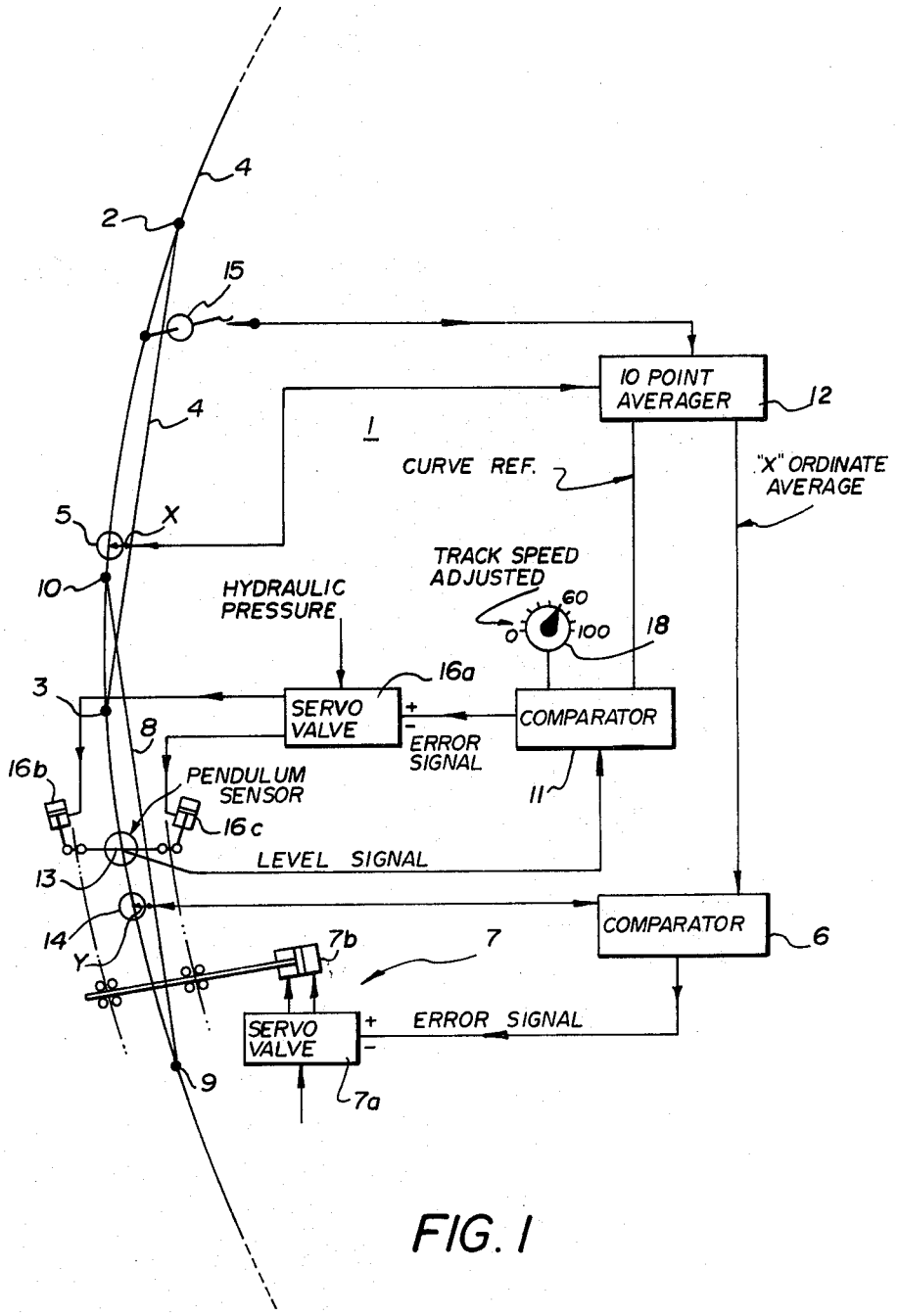
FIG. 1 illustrates in diagrammatic form an embodiment of a track position error and realigning apparatus described and claimed in the above described copending U.S. application Ser. No. 844,819.

An apparatus for calculating the track position error and realigning railway track is shown generally at 1. A first measuring system comprises leading and trailing points 2,3 being conveniently located on rail engaging buggies forming a frame, each point being located at the track center line. Between the points 2,3, is chord forming structure forming a chord 4 which structure is conveniently merely a 20 meter long wire pulled taut between the two points. A measuring device 5 of any suitable design is located at a predetermined point between points 2,3 for obtaining the distance of the chord from the track at the predetermined point. Conveniently, the measuring device is a fork which engages the wire and pivots to the right or left relative to a frame mounted indicator thereby giving the amount of deviation between the track and chord. The frame mounted indicator is, suitably, a rotary differential transformer which derives an analog voltage dependent on the deviation. The measuring device 5 is operated in conjunction with a distance measuring apparatus shown schematically at 15 such that at convenient increments, for example every two meters, a contact is closed to sample the analog voltage on the transformer.

An averaging apparatus 12 receives the analog voltages sampled. The averaging apparatus 12 is designed to receive the analog voltages sampled at consecutive points, sum them and obtain a mean track position value over the twenty meter distance travelled. The apparatus 12 may conveniently include an analog to digital converter, the digital values being subsequently summed and divided by the number of samples. It should be understood that as the apparatus traverses the track continuously the first of the ten samples is dropped and a new sample is added to the remaining nine and in this way a running average is obtained every 2 meters.

A second measuring system comprises leading and trailing points 9,10 also conveniently located at the track center line on rail engaging buggies forming a second frame. Associated with the second frame and stretched between the points 9,10 is a second chord forming structure which is 20 meters long taut wire forming a second chord or reference line 8 and a second measuring device 14 which operates in a manner identical to that of measuring device 5 and obtains the track distance from chord 8 at successive points.

Comparator 6, well known in the art, is provided which utilizes as two inputs, respectively, the mean track distance calculated by averager 12 and the track distance "y" obtained by the second measuring device 14. The magnitude of the voltage output from the comparator 6 depends on the difference between the mean track distance and the track distance "y".

The error output voltage from comparator 6 is forwarded to track correcting means 7 which can be any suitable device for shifting track laterally as in known in the art, e.g. a servo value *7a* controlling hydraulic jack *7b*. The track correcting means 7 thereby realigns the track in accordance with the magnitude and sign of the error signal from comparator 6 in a sense to reduce or remove the error.

In an arrangement which has proved very satisfactory, the measuring devices 5 and 14 were located 4 meters from the rear points 3 and 9 of their respective chords and the chords were overlapped such that the point 3 of the first chord was adjacent the midpoint of the second chord and the point 10 of the second chord was adjacent the mid point of the first chord. The overlapping of the chords conveniently reduces the overall length of the apparatus but there is a limit to the overlapping as excessive overlapping would tend to reduce the accuracy of the results. This is because the ten sample readings obtained and stored by the first measuring device are normally obtained over e.g. the twenty meters immediately behind the device 5, ten of which meters are behind the particular point being measured by device 14 and having in the meantime been corrected, so that half of the stored samples upon which the mean value is obtained are taken on a section of the track which has subsequently been corrected. Thus, the distance between the measuring devices 5 and 14 determines the maximum distance over which the samples can be taken.

Because of the overlapping chords it is possible to incorporate a feedback provision into the averager 12 by arranging that the sensing device 14 and track correcting means 7 are located at point 3, i.e. the trailing end of the first chord. Thus, the trailing end 3 of chord 4 is continuously moved to a corrected position on the track as the track correcting device 7 operates. The corrected point 3 represents a more exact reference point than uncorrected point 3 and so any value measured by measuring device 5 when chord 4 terminates at the corrected point 3 is, obviously, more accurate. The system can, therefore be arranged to derive measurements from measuring device 5 while the point 3 is on the corrected portion of the track, i.e. immediately after operation of the track correcting device, these being the values which are stored and sampled.

As an additional feature of the invention it is possible to incorporate a device for measuring the superelevation of the track. According to the A.R.A. standard, the superelevation of a railroad track "x" is given by the formula $E=0.0007\ V^2D$ where:

E=the superelevation in inches,

V=the proposed train speed in miles per hour, and

D=the curvature of the track in degrees measured as the angle subtended by the radii from a 100 foot chord.

The device includes a comparator 11 to which is fed an output from the averager 12 which output is obviously related to the track curvature D.

The second input to the comparator 11 originates by the provision of a track speed adjuster 18. If the proposed train speed V, for example, is 60 miles/hr., this value is simply selected on the track speed adjuster whereby it is fed to the comparator 11.

The third input to the comparator 11 is derived from a pendulum sensor 13 which is carried by the apparatus on the track center line near the sensing device 14. The sensor 13 is well known in the art and derives an analog voltage the magnitude and sign of which depends on by how much the outer rail of the curve differs from the inner rail.

The comparator 11 compares this superelevation with $0.0007\ V^2D$ and any resultant signal denotes the magnitude of the track superelevation error.

This signal commands a servo value **16*a* to operate a hydraulic lifting jack 16*b* or 16*c*** depending on which rail has to be lifted.

It should be understood that the voltages passed to the first two inputs of the comparator have to be matched to the voltage produced by the pendulum and, thus, constants based on the parameters of the pendulum must be used to process the voltages on the first two inputs. This is preferably done in the comparator.

Figure 2:
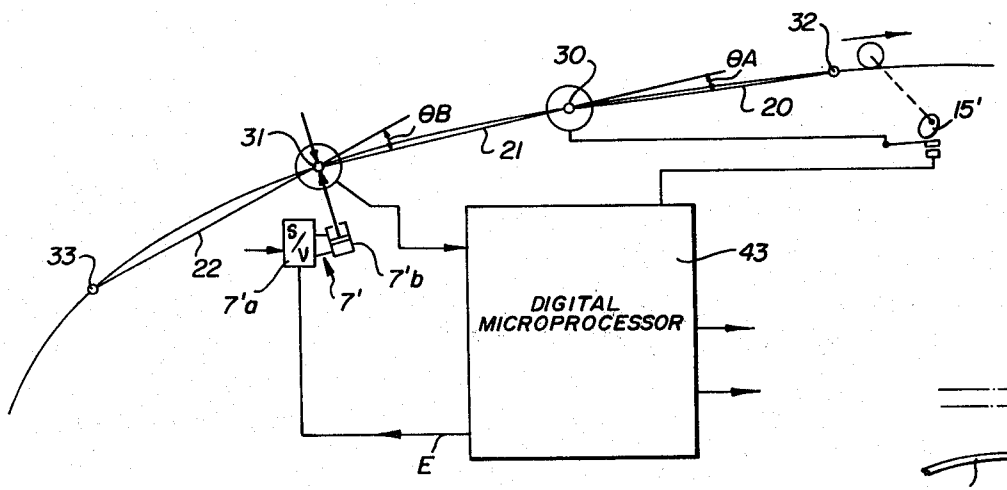
FIG. 2 illustrates in diagrammatic form an embodiment of a track measurement and correction apparatus according to the present invention in which angles rather than displacements are measured.
Figure 3:
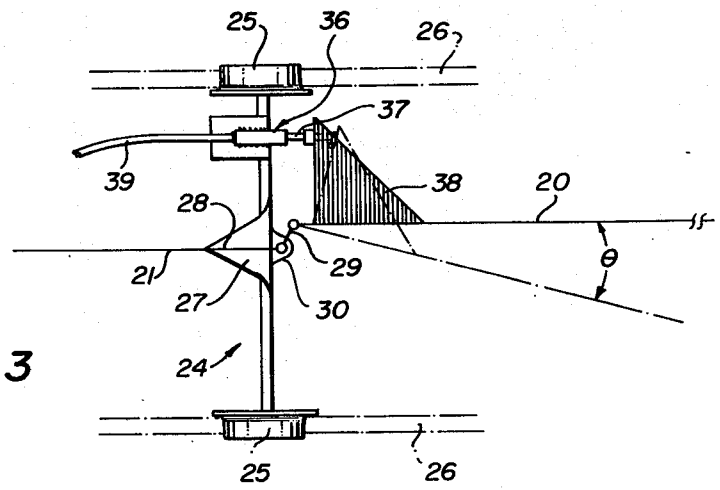
FIG. 3 is a diagrammatic illustration of the manner in which the angles are measured in the system of FIG. 2.

FIGS. 2 and 3 disclose a system somewhat similar to that described with relation to FIG. 1 but which is modified for use with angle measurement.

For this reason, as shown in FIGS. 2 and 3, instead of two chords there are three which are identified by the reference numerals 20, 21 and 22. In principle, the chords could be formed by any suitable structure such as taut wires but, in practice, the use of stiff push rods each 10 meters long for example, is preferred. The push rods are fixed at their forward ends to rail engaging buggies and are hinged at their rearward ends to the buggies. FIG. 3 shows the portion of the system between the rearward end of push rod 20 and the forward end of push rod 21, it being understood that the portion of the system between the rearward end of push rod 21 and the forward end of push rod 22 will be identical.

As can be seen in FIG. 3, a buggy 24 comprises a pair of wheels 25 which engage the rails 26 and a frame 27 to which is attached the forward end of push rod 21 at a point 28 mid-way between the rails 26. The rearward end of the push rod 20 is provided with a hinge pin 29 which is rotatable in a socket 30 also provided mid-way between the rails 26. In practice, the point 28 and the socket 30 would be very close together and are shown as the single point 30 in FIG. 2. Also in FIG. 2, the point at which the rearward end of push rod 21 and the forward end of push rod 22 are joined to the next buggy is referenced 31, the point at which the forward end of push rod 20 is joined to the first buggy 15 referenced 32 and the point at which the rearward end of push rod 22 is jointed to the last buggy is referenced 33. The points 31, 32 and 33 are, like point 30, provided at the control longitudinal axis of the track. The rods 20 and 21 thus constitute first means forming two chords, and the rods 21 and 22 constitute second means forming two chords.

It will be readily appreciated that when the first two buggies are on a straight portion of track the push rods 20 and 21 will be coaxial but when the first buggy, i.e. the buggy which defines point 32 runs on a curved portion of track the push rod 20 will be pivoted at its pin 29 with respect to the socket 30 and a small angle will be derived between push rods 20 and 21 at point 30. Any suitable means for measuring this angle may be used. For example, as shown, a linear variable differential transformer (LVDT) 36 may be mounted on the frame 27 of the buggy 24 at a location lateral with respect to the socket 30. The armature 37 of the LVDT 36 is connected in any appropriate way to the push rod 20 such as by means of a bracket 38 shown in FIG. 3.

The LVDT 36 may be adjusted so that when the rods 20 and 21 are coaxial the voltage derived is zero. When the armature 37 is extended or retracted as a result of the push rod 20 pivoting round point 30 a voltage is derived by the LVDT and this voltage is fed along a cable 39 to circuitry shown in FIG. 2. For small values of $\theta_A$, the angle between push rods 20 and 21, $\theta_A$ is directly proportional to the voltage derived by LVDT 36 and the sign of the voltage derived indicates whether push rod 20 is pivoting to the right or left. Thus LVDT 36 produces a continuous analog voltage indicative of $\theta_A$ and a similar LVDT (not shown) positioned at the portion of the system between push rod 21 and push rod 22 produces a continuous analog voltage indicative of $\theta_B$, the angle between push rods 21 and 22.

The analog voltages thus derived are used in a manner identical to the analog voltages derived in the core of the system shown in FIG. 1. Thus, a distance measuring apparatus 15' causes an associated contact 15 close at convenient increments, for example every two meters, to sample the voltage on the LVDT 36. This sampled voltage is then passed to a digital microprocessor 43 which is understood to include an analog/digital converter, ten point averager 12' and comparator 0' as in the first embodiment. The ten point averager produces a digital signal indicative of the mean value of $\theta_A$ over a twenty meter distance and this digital signal is compared in comparator 0' with a digital value obtained by analog/digital converting the analog voltage obtained from the LVDT at the point 31.

The error output voltage, produced on line E is used to control a track correcting means 7', which as before, may be a servo valve 7'*a* controlling hydraulic jack 7'*b*. The track correcting means 7' thereby aligns the track in accordance with the magnitude and sign of the error signal from comparator 6 in a sense to reduce or remove the error.

As with the system shown in FIG. 1, the ten sample readings obtained by the first angle measuring device (LVDT) 36 are normally obtained over the ten meters immediately preceding and the ten meters immediately following the particular point being measured by the second angle measuring device (LVDT).

The digital microprocessor 42 may also include a comparator and track speed adjuster for deriving a signal denoting the magnitude of the required superelevation exactly in the manner described in the system shown in FIG. 1. As before, a pendulum sensor identical to pendulum sensor 13 would be used and servo operated hydraulic lifting jacks identical to jacks 16*b* and 16*c* would be controlled by the derived signal to obtain the required amount of superelevation.

It should be understood that, in both embodiments described, the track correcting means 7 or 7' and hydraulic lifting jacks should be located as close as possible to the location of the second measuring device and pendulum sensor, respectively. Trailing point 31 of chord 21 is being continuously corrected and greater system accuracy can be obtained by obtaining the value of angle $\theta_A$ after correction of trailing point 31 in much the same manner as with the embodiment of FIG. 1 as described above.

While the invention has been described as carried out in specific embodiments, it is not desired to be limited thereby but rather it is intended to cover the invention within the spirit and scope of the appended claims.

What I claim as my invention is:

1. Apparatus for reducing railroad track alignment errors comprising a first measuring system having a first forward chord forming structure both ends of which are located adjacent pairs of track engaging wheels and each end being located intermediate a respective pair of wheels and a first rearward chord forming structure both ends of which are located adjacent pairs of track engaging wheels and each end being located intermediate a respective pair of wheels, the rearward end of the first forward chord forming structure being fixed closely adjacent the forward end of the first rearward chord forming structure, the first chord forming structures being relatively pivotable to define a variable angle therebetween measured at the adjacent ends of the two first chord forming structures, means located at the adjacent ends of the first chord forming structures to measure the variable angle, means to move the first measuring system along a section of track for enabling the variable angle measuring means to measure said variable angle at a series of locations, means for storing and averaging the values obtained at said series of locations and obtaining an average value, a track position correcting means attached to and trailing the first measuring system, a second measuring system associated with the track correcting means and having a second forward chord forming structure both ends of which are located adjacent pairs of track engaging wheels and each end being located intermediate a respective pair of wheels and a second rearward chord forming structure both ends of which are located adjacent pairs of track engaging wheels and each end being located intermediate a respective pair of wheels, the rearward end of the second forward chord forming structure being fixed closely adjacent the forward end of the second rearward chord forming structure, the second chord forming structure being relatively pivotable to define a variable angle therebetween measured at the adjacent ends of the two second chord forming structure, means located at the adjacent ends of the two second chord forming structures to measure the angle at a particular track location, means to compare said average angle value with the angle value obtained by the second measuring system at said particular track location and provide an angle error value, and means for applying said angle error value to control the operation of the track position correcting means to reduce an existing track alignment error.

2. Apparatus as claimed in claim 1 in which a single chord forming structure serves as both the first rearward chord forming structure and the second forward chord forming structure, there being three chord forming structures in total.

3. Apparatus as claimed in claim 2, in which the chord forming structures are rods.

4. Apparatus as claimed in claim 3 in which the forewardmost of the three rods is hingedly connected at its rear end adjacent the forward end of the intermediate rod which, in turn, is hingedly connected at its rear end adjacent the forward end of the rearmost rod.

5. Apparatus as claimed in claim 4 in which each angle measuring means is a linear variable differential transformer having a coil rigidly mounted relative to one of the rods of each adjoining pair of rods and an armature mounted on the other rod of each adjoining pair, the transformer deriving an output signal varying in magnitude and polarity according to the degree and direction of pivoting.

6. Apparatus as claimed in claim 1 in which the means to store and average the values obtained at the series of locations includes means to progressively drop off the value obtained by the first measuring system at a first sequential one of the series of locations and adding on a new value obtained at a successive location thereby to obtain a running average.

7. Apparatus as claimed in claim 6, in which the second measuring system has means operatively associated therewith to operate the angle measuring means of the second measuring system at a second series of locations whereby the angle value at each of these locations can be compared with the running average value.

8. Apparatus as claimed in claim 6 in which the first and second measuring systems are positioned to obtain angle values at the same series of locations.

9. Apparatus as claimed in claim 1, in which the second measuring means is positioned to obtain an angle value mid-way between the first and last locations of the series of locations at which the first measuring means obtains angle values.

10. A method of correcting the superelevation of one rail of a railroad track relative to the other in accordance with a predetermined formula relating superelevation to curvature of a track section and the speed for which the track section is designed, comprising the steps of passing a measuring system along the section and obtaining measurements indicative of the track position at a first series of locations throughout the section, automatically summing and averaging the measurements to obtain an average value, automatically computing a desired superelevation value corresponding to said average value, passing track correcting means equipped with track measurement means along said section of track and obtaining a measurement at at least one location which measurement is indicative of the superelevation of the rails at that location, comparing the computed superelevation value with the value obtained at said one location to obtain an error signal and applying the error signal to control the operation of track lifting means to raise one rail relative to the other to achieve the computed superelevation.

11. A method as claimed in claim 10 in which a running average value ia obtained by progressively dropping off the value obtained by the measuring system at a first sequential one of the first series of locations and adding on a new value obtained at a successive location, the running average being used to compute automatically a running value for superelevation.

12. A method as claimed in claim 1 in which the superelevation is measured at a second series of locations on the section and the value of superelevation at these locations is compared with the computed running value for superelevation computed.

13. A method as claimed in claim 10 in which the measurements indicative of the track position which are obtained are distances of the track from a reference chord extending between points on the track.

14. A method as claimed in claim 10 in which the measurements indicative of the track position which are obtained are angles defined by two adjoining chords extending between points on the track.

15. Apparatus for correcting the superelevation of one rail of a railroad track relative to another on a section of the track comprising a first measuring system having measuring means for obtaining a measurement which is indicative of the track position, means to move the first measuring system along a section of the track for enabling the measuring means to obtain measurements at a first series of locations, means for storing and averaging the values obtained at the first series of locations and for obtaining an average value, means to compute automatically from the average value and a desired operating speed of a train along the section a computed value for the superelevation of the section, a track correcting means attached to and trailing the first measuring system, said track correcting means having a second measuring system for measuring the elevation of one rail of the track with respect to the other at at least one location on the section to obtain an actual superelevation value, means to compare the actual superelevation value with the computed superelevation value to obtain an error value, and means for applying the error value to control the operation of the track correcting means to raise one rail of the track relative to the other to achieve the computed superelevation value.

16. A method of reducing railroad track alignment errors comprising the steps of passing a measuring system along a section of the track having a control longitudinal axis, the measuring system having first means forming two chords the ends of which are located on said track axis, the chords extending respectively between a first point and a second point and between the second point and a third point, and measuring the angle defined by the two chords of the first means at a first series of locations throughout said section, automatically summing and averaging the thus measured angles to obtain an average angle value, passing track correcting means equipped with second means forming two chords the ends of which are located on said track axis, the chords extending respectively between a fourth point and a fifth point and between the fifth point and a sixth point, and equipped with a track angle sensing means along said section of track, obtaining a value for the angle defined by the two chords of the second means at at least one location on said section, comparing the actual angle value obtained at said at least one location with said average angle value to obtain an angle error value and applying the angle error value to control the operation of track position correcting means to reduce an existing track alignment error at the one location.

17. A method as claimed in claim 16 in which a running average angle value is obtained by progressively dropping off the value obtained by the measuring system at a first sequential one of the first series of locations and adding on a new value obtained at a successive location.

18. A method as claimed in claim 17, in which a value for the angle defined by the track relative to the reference line is obtained by the sensing means at a second series of locations on the section and the angle value at each of these locations is compared with the running average angle value.

19. A method as claimed in claim 18, in which the first series of locations and the second series of locations coincide.

20. A method as claimed in claim 19 in which the step of passing the track correcting means along the track immediately follows the step of passing the measuring system along the track.

21. A method as claimed in claim 18, in which each location at which the angle value is sensed by the sensing means is mid-way between the first and last locations over which the particular average value which is compared with the value sensed is obtained.

22. A method as claimed in claim 16, in which the location at which the angle value sensed by the sensing means is mid-way between the first and last locations of the first series of locations.

23. Apparatus for reducing railroad track alignment errors in a railroad track having a control longitudinal axis, said apparatus comprising a first measuring system having a first means forming two chords the ends of which are located on said track axis, the chords extending respectively, between a first point and a second point and between the second point and a third point, a measuring means for measuring the variable angle defined by the two chords of the first means, means to move the first measuring system along a section of track for enabling the measuring means to measure said variable angle at a first series of locations, means for storing and averaging the values obtained at said first series of locations, and obtaining an average angle value, a track position correcting means attached to and trailing the first measuring system and having second means forming two chords the ends of which are located on said track axis, the chords extending, respectively, between a fourth point and a fifth point and between a fifth point and a sixth point, a second measuring system associated with the track correcting means for measuring the variable angle defined by the two chords of the second means at at least one location on the section, means to compare the actual angle obtained at said at least one location with said average angle value to obtain an angle error value, and means for applying the angle error value to control the operation of the track position correcting means to reduce an existing track alignment error at the one location.

24. Apparatus as claimed in claim 23 in which the means to store and average the values obtained at the series of locations includes means to progressively drop off the value obtained by the first measuring system at a first sequential one of the series of locations and adding on a new value obtained at a successive location thereby to obtain a running average.

25. Apparatus as claimed in claim 24 in which the second measuring system has means operatively associated therewith to operate the angle measuring means of the second measuring system at a second series of locations whereby the angle value at each of these locations can be compared with the running average value.

26. Apparatus as claimed in claim 25 in which the first and second measuring systems are positioned to obtain angle values at the same series of locations.

27. Apparatus as claimed in claim 23 in which the second measuring means is positioned to obtain an angle value mid-way between the first and last locations of the series of locations at which the first measuring means obtains angle values.

* * * * *